US007568345B2

(12) United States Patent
Furletov et al.

(10) Patent No.: US 7,568,345 B2
(45) Date of Patent: Aug. 4, 2009

(54) EFFERVESCENCE INJECTOR FOR AN AERO-MECHANICAL SYSTEM FOR INJECTING AIR/FUEL MIXTURE INTO A TURBOMACHINE COMBUSTION CHAMBER

(75) Inventors: Victor Ivanovich Furletov, Moscow (RU); Thomas Olivier Marie Noel, Paris (FR); Gilles Louis Rollin, Blandy les Tours (FR); Alexander Jurevich Vasilev, Moscow (RU); Victor Ivanovich Yagodkin, Moscow (RU)

(73) Assignee: Snecma, Paris (FR)

( * ) Notice: Subject to any disclaimer, the term of this patent is extended or adjusted under 35 U.S.C. 154(b) by 615 days.

(21) Appl. No.: 11/232,002

(22) Filed: Sep. 22, 2005

(65) Prior Publication Data

US 2006/0059915 A1 Mar. 23, 2006

(30) Foreign Application Priority Data

Sep. 23, 2004 (FR) ..... 04 10051

(51) Int. Cl.
*F02C 1/00* (2006.01)
*F02G 3/00* (2006.01)

(52) U.S. Cl. ..... 60/742; 60/737; 60/740; 60/748

(58) Field of Classification Search ..... 60/737, 60/733, 740, 742, 748; 239/533.2
See application file for complete search history.

(56) References Cited

U.S. PATENT DOCUMENTS

| | | | | |
|---|---|---|---|---|
| 1,512,132 | A | | 10/1924 | Pfahl |
| 3,608,831 | A | | 9/1971 | Place et al. |
| 3,703,259 | A | * | 11/1972 | Sturgess et al. ..... 239/400 |
| 5,697,553 | A | | 12/1997 | Stotts |
| 6,128,894 | A | | 10/2000 | Joos et al. |
| 2003/0131600 | A1 | | 7/2003 | David et al. |

FOREIGN PATENT DOCUMENTS

| | | |
|---|---|---|
| DE | 26 45 754 A1 | 4/1978 |
| DE | 39 13 124 A1 | 12/1989 |
| FR | 2 538 880 | 7/1984 |
| GB | 1 272 757 | 5/1972 |

OTHER PUBLICATIONS

S.D. Sovani, et al. "Effervescent Atomization"; Progress in Energy and Combustion Science, Elsevier Science Publishers, Amsterdam, NL; vol. 27; No. 4; 2001; pp. 483-521; XP004232485; ISSN 0360-1285.

* cited by examiner

*Primary Examiner*—Michael Cuff
*Assistant Examiner*—Gerald L Sung
(74) *Attorney, Agent, or Firm*—Oblon, Spivak, McClelland, Maier & Neustadt, P.C.

(57) ABSTRACT

A fuel injector for an aero-mechanical injection system for injecting an air/fuel mixture into a turbomachine combustion chamber, the injector comprising a main tubular structure of axis XX' opening out at a downstream end for delivering the air/fuel mixture, a tubular fuel duct that is disposed inside the main structure and that opens out into the main structure via a fuel atomizer plug so as to introduce fuel into the main structure at a pressure $P_C$ into the main structure, at least one air feed channel that opens out into the main structure so as to introduce air at a pressure $P_A$ therein, and means for injecting into the fuel duct a gas at a pressure $P_G$ that is greater than $P_A$ and greater than or equal to $P_C$ so as to create effervescence in the fuel on being introduced into the main structure.

18 Claims, 4 Drawing Sheets

EFFERVESCENCE INJECTOR FOR AN AERO-MECHANICAL SYSTEM FOR INJECTING AIR/FUEL MIXTURE INTO A TURBOMACHINE COMBUSTION CHAMBER

BACKGROUND OF THE INVENTION

The present invention relates to the general field of systems for injecting an air/fuel mixture into a turbomachine combustion chamber. It relates more particularly to a fuel injector for an injection system of the aero-mechanical type provided with means for atomizing the fuel prior to mixing with air.

The conventional process for designing and optimizing a turbomachine combustion chamber seeks mainly to reconcile implementing the operational performance of the chamber (combustion efficiency, stability domain, ignition and re-ignition domain, lifetime of the combustion area, etc.) as a function of the intended mission for the airplane on which the turbomachine is mounted, while minimizing emissions of pollution (nitrogen oxides, carbon monoxide, unburnt hydrocarbons, etc.). To do this, it is possible in particular to act on the nature and the performance of the injection system for injecting the air/fuel mixture into the combustion chamber, on the distribution of dilution air inside the chamber, and on the dynamics of air/fuel mixing within the chamber.

The combustion chamber of a turbomachine typically comprises an injection system for injecting an air/fuel mixture into a flame tube, a cooling system, and a dilution system. Combustion takes place mainly within a first portion of the flame tube (referred to as the "primary zone") in which combustion is stabilized by means of air/fuel mixture recirculation zones induced by the flow of air coming from the injection system. In the second portion of the mixer tube (referred to as the "dilution zone"), the chemical activity that takes place is less intense and the flow is diluted by means of dilution holes.

In the primary zone of the flame tube, various physical phenomena are involved: injection and atomization into fine droplets of the fuel, evaporation of the droplets, mixing of fuel vapor with air, and chemical reactions of fuel being oxidized by the oxygen of the air.

These physical phenomena are governed by characteristic times. Atomization time thus represents the time needed by the air to disintegrate the sheet of fuel and form an air/fuel spray. It depends mainly on the performance and the technology of the injection system used and on the aerodynamics in the vicinity of the sheet of fuel. Evaporation time also depends on the injection system used. It is a function directly of the size of the droplets resulting from the disintegration of the sheet of fuel; the smaller the droplets, the shorter the evaporation time. Mixing time corresponds to the time needed for the fuel vapor coming from evaporation of the droplets to mix with the air. It depends mainly on the level of turbulence within the combustion area, and thus on the flow dynamics in the primary zone. Chemical time represents the time needed for the chemical reactions to develop. It depends on the pressures and temperatures at the inlet to the combustion area and on the nature of the fuel used.

The injection system used thus plays a fundamental role in the process of designing a combustion chamber, in particular when optimizing the times that are characteristic of fuel atomization and evaporation.

There exist two main families of injection systems: "aero-mechanical" systems in which the fuel is atomized as a result of a large pressure difference between the fuel and the air; and "aerodynamic" systems in which the fuel is atomized by being sheared between two sheets of air. The present invention relates more particularly to systems of the aero-mechanical type.

Aero-mechanical injection systems known in the prior art present numerous drawbacks. In particular, the pressure limitation does not enable the size of fuel droplets to be reduced sufficiently. Furthermore, the air/fuel spray created by such injection systems is not always stable at all operating speeds of the engine.

OBJECT AND SUMMARY OF THE INVENTION

A main object of the present invention is thus to mitigate such drawbacks by proposing an injector for an aero-mechanical injection system that enables the times characteristic of fuel atomization and evaporation to be reduced under all operating speeds of the turbomachine.

To this end, the invention provides a fuel injector for an aero-mechanical injection system for injecting an air/fuel mixture into a turbomachine combustion chamber, the injector comprising: a main tubular structure of axis XX' opening out at a downstream end for delivering the air/fuel mixture; a tubular fuel duct disposed inside the main structure so as to co-operate therewith to form an annular passage, and opening out at a downstream end into the main structure via a fuel atomizer plug so as to introduce fuel at a pressure $P_C$ into the main structure; and at least one air feed channel connected to a compressor stage of the turbomachine and opening out into the annular passage in such a manner as to introduce air at a pressure $P_A$ into said passage, the injector further comprising means for injecting a gas into the fuel duct, the gas being at a pressure $P_G$ that is greater than $P_A$ and greater than or equal to $P_C$, in order to create effervescence in the fuel while it is being introduced into the main structure.

Injecting gas into the fuel duct at a pressure that is greater than or equal to the pressure of the fuel creates a liquid/gas mixture at the pressure $P_C$ prior to its introduction into the main structure in which it will be dispersed. As this mixture expands from the pressure $P_C$ to the internal pressure within the main structure, the sudden expansion of the gaseous phase causes the sheet of fuel to disintegrate: this is referred to as effervescence. As a result, the times characteristic of the fuel atomizing and evaporating at the outlet from the injection system can be reduced considerably.

At low operating speeds of the turbomachine, these shorter times enable combustion efficiency to be improved and increase the ability of the combustion area to avoid going out, and at full-throttle operating speed of the turbomachine they serve to limit the formation of polluting emissions of the nitrogen oxide and soot types.

More particularly, the injector includes a tubular gas duct which is disposed inside the fuel duct and has a plurality of orifices opening out into the fuel duct.

Advantageously, the orifices of the gas duct open out substantially perpendicularly into the fuel duct and they are disposed in at least one common transverse plane.

The fuel atomizer plug may comprise a cylindrical portion centered on the axis XX', having an outside diameter that is smaller than the inside diameter of the fuel duct, and provided with a plurality of profiled fins extending radially outwards, said fins having outside surfaces coming into contact with an inside surface of the fuel duct.

Preferably, the profiled fins of the fuel atomizer plug are distributed regularly over the entire circumference of the cylindrical portion. They may be twisted angularly, preferably by about 45°, in the same direction.

In an embodiment of the invention, the orifices of the gas duct open out into the fuel duct through the fuel atomizer plug.

More particularly, the orifices of the gas duct open out between pairs of adjacent fins of the fuel atomizer plug and open out tangentially into the gas duct.

In another embodiment of the invention, the orifices of the gas duct open out into the fuel duct upstream from the fuel atomizer plug.

According to an advantageous characteristic of the invention, a device is provided for controlling the flow rate of the gas injected into the fuel duct.

The present invention also provides an aero-mechanical injection system fitted with a fuel injector as defined above.

BRIEF DESCRIPTION OF THE DRAWINGS

Other characteristics and advantages of the present invention appear from the following description made with reference to the accompanying drawings which show an embodiment that has no limiting character. In the figures.

DETAILED DESCRIPTION OF AN EMBODIMENT

Figure 1:
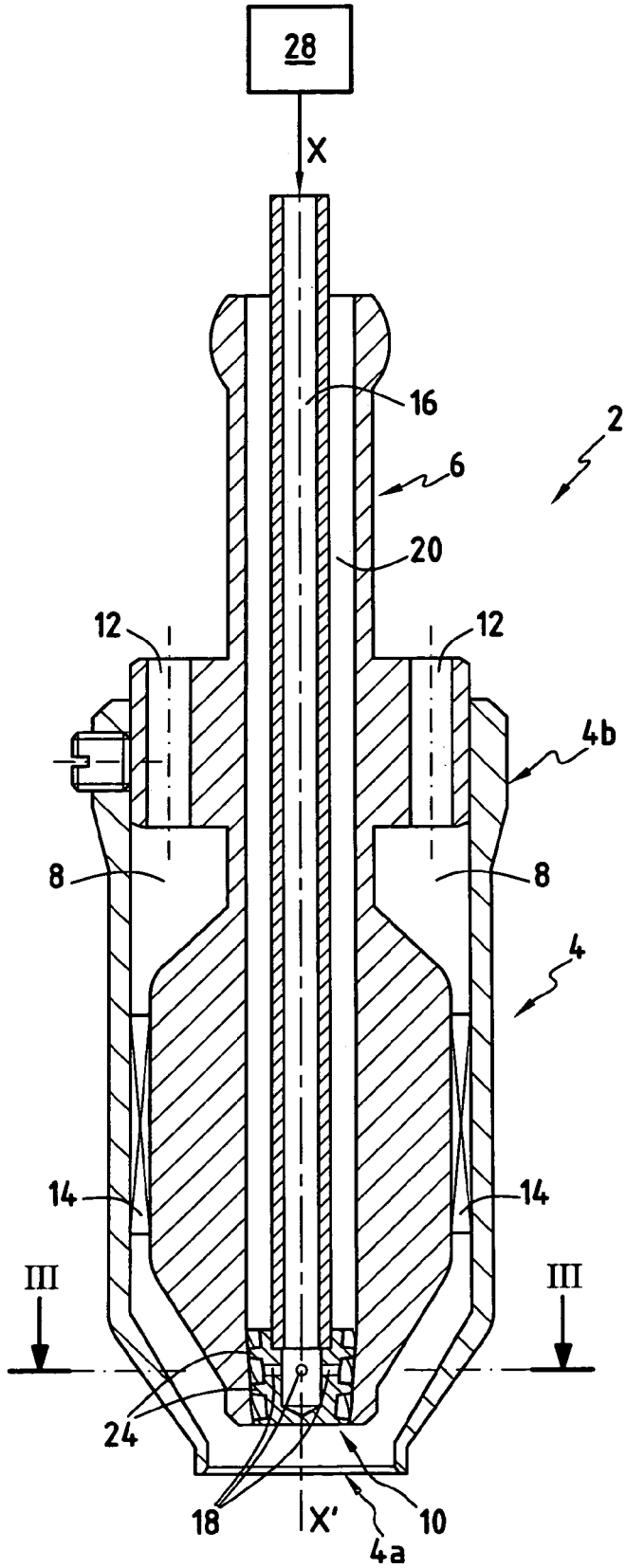
FIG. 1 is a longitudinal section view of an injector constituting an embodiment of the invention.
Figure 4:
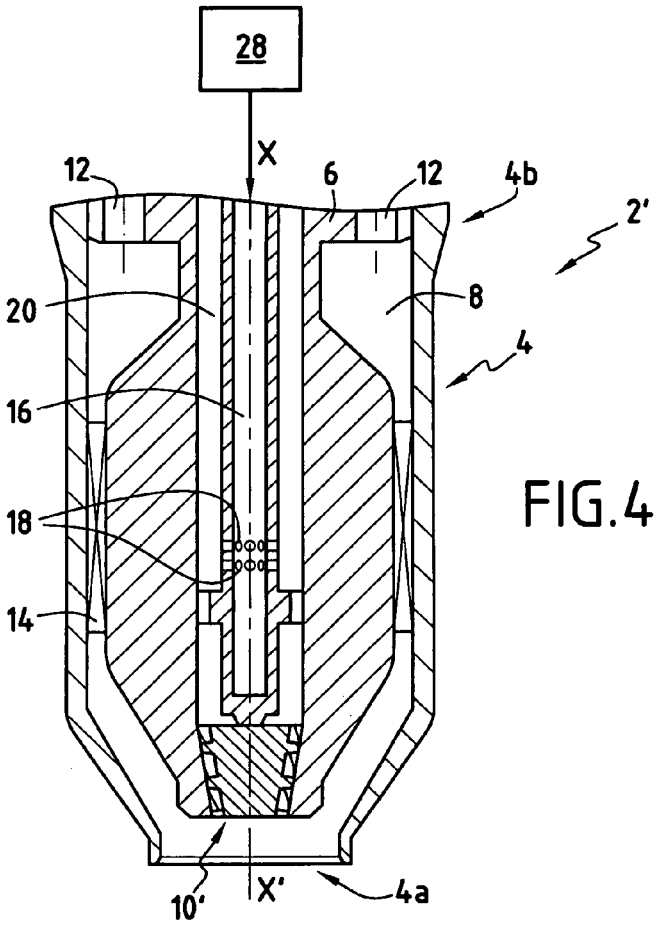
FIG. 4 is an axial section view of an injector in another embodiment of the invention.

With reference to FIGS. 1 and 4, the fuel injector 2, 2' of the invention is generally in the form of a main tubular structure 4 about an axis XX' that opens out at a downstream end 4*a* for delivering the air/fuel mixture. The downstream end 4*a* of the tubular structure 4 may be substantially conical in shape.

A tubular fuel duct 6 is disposed inside the main structure 4 so as to co-operate therewith to form an annular passage 8. The tubular duct 6 which is centered on the axis XX' opens out at a downstream end inside the main structure 4 via a fuel atomizer plug 10, 10'. Its downstream end may also be substantially conical in shape.

The fuel atomizer plug 10, 10' serves to introduce fuel at a pressure $P_C$, e.g. of about 4 bar to 80 bar, into the main structure 4 at its downstream end 4*a*. Its main function is to cause the fuel to be dispersed in the form of a plurality of jets (or tubes) of fuel.

The fuel injector 2, 2' further comprises at least one air feed channel 12 that is connected to a compressor stage (not shown) of the turbomachine and that opens out into the annular passage 8 so as to introduce air therein at a pressure $P_A$, e.g. of the order of 0.5 bar to 50 bar.

In the embodiments shown in FIGS. 1 and 4, the fuel injector 2, 2' thus presents a plurality of air feed channels 12 that are regularly distributed around the axis XX' and that open out into the annular passage 8 in the vicinity of the upstream end 4*b* of the main structure 4.

An air swirler 14 can be disposed in the annular passage 8 between the upstream and downstream ends 4*a* and 4*b* of the main structure 4. Such an air swirler 14 serves to impart a rotary effect (or "swirl") to the flow of air in the annular passage 8.

The air flowing in the annular passage 8, optionally caused to swirl by the air swirler 14, then comes to break up the jets of fuel created by the fuel atomizer 10, 10' in the vicinity of the downstream end 4*a* of the main structure 4. Under the combined effect of the fuel atomizer 10, 10' and of the air flowing in the annular passage 8, an air/fuel spray is created at the outlet from the injector.

According to the invention, the fuel injector 2, 2' further comprises means for injecting a gas into the fuel duct 6, which gas is at a pressure $P_G$ that is greater than the pressure $P_A$ and greater than or equal to the pressure $P_C$, so as to create effervescence in the fuel on being introduced into the main structure 4.

More particularly, a tubular gas duct 16 is disposed inside the fuel duct 6 and has a plurality of orifices 18 opening out into the fuel duct 6. The gas duct 16 is likewise centered on the axis XX' and co-operates with the fuel duct 6 to form an annular passage 20 for the flow of fuel.

Introducing gas into the fuel duct 6 at a pressure $P_G$ greater than the pressure $P_A$ and greater than or equal to the pressure $P_C$ serves to create a liquid/gas mixture at the pressure $P_C$ prior to its introduction into the main structure 4. The effervescence of the fuel is characterized by the fuel atomizing as the result of the gas expanding suddenly on being introduced into the main structure 4. The times characteristic of fuel atomization and evaporation are thus shortened.

More particularly, fuel effervescence occurs when the following conditions are satisfied: the gas must be at a pressure $P_G$ that is at least substantially equal to the pressure $P_C$ of the fuel (or at a pressure that is slightly greater than that), and liquid/gas mixing must take place in a space that is substantially confined so that the mixture is at the pressure $P_C$ (specifically, mixing takes place in the zone of confluence between the orifices 18 and the fuel duct 6 into which they open out).

The gas is preferably an inert gas that has no direct influence on the subsequent combustion of the air/fuel mixture. For example the gas may be air taken from a compressor stage of the turbomachine and that is further compressed in order to reach a pressure $P_G$ greater than the pressure $P_A$ of the air being fed to the air feed channels 12.

According to an advantageous characteristic of the invention, the orifices 18 of the gas duct 16 open out substantially perpendicularly into the fuel duct 6. This particular arrangement serves to encourage the appearance of effervescence in the fuel.

Alternatively, the orifices 18 may slope downstream relative to the axis XX', e.g. at about 60°.

According to another advantageous characteristic of the invention, the orifices 18 of the gas duct 16 are disposed in at least one common transverse plane (in two transverse planes in FIG. 4).

Figure 2:
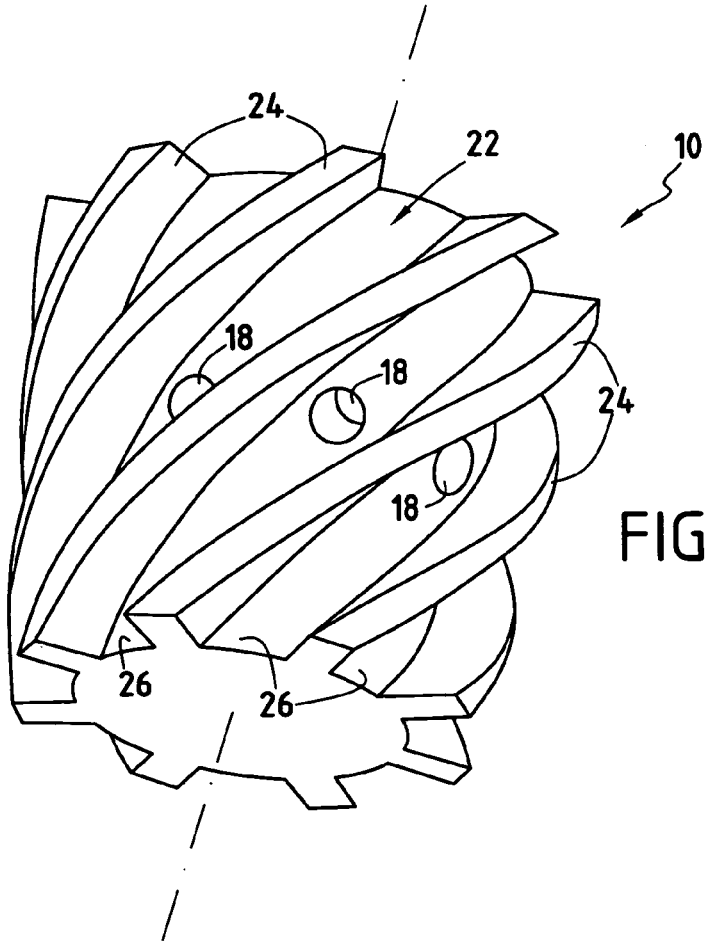
FIG. 2 is a perspective view of the fuel atomizer plug of the FIG. 1 injector.

As shown in FIG. 2, the fuel atomizer plug 10 may comprise a substantially cylindrical portion 22 centered on the axis XX', having an outside diameter that is smaller than the inside diameter of the fuel duct, and it may be provided with a plurality of profiled fins 24 that extend radially outwards.

Figure 3:
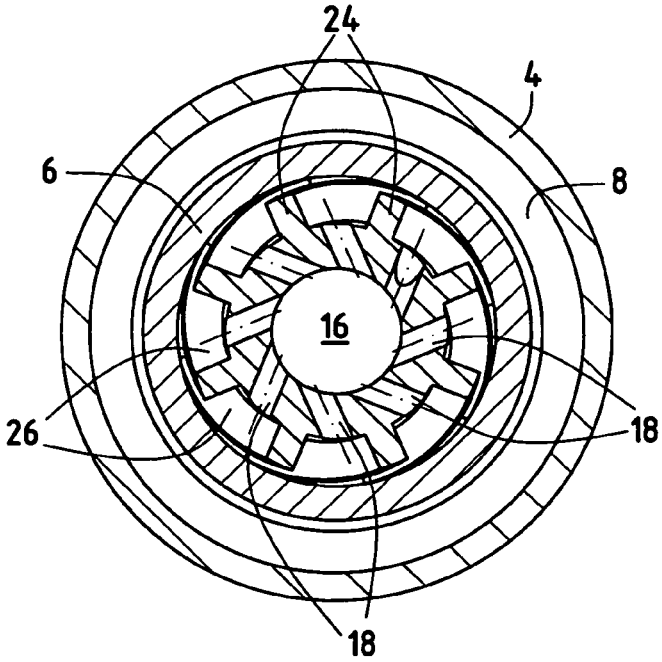
FIG. 3 is a section view on III-III of FIG. 1.

The profiled fins 24 together present an outside surface that comes into contact with an inside surface of the fuel duct 6 (FIGS. 1, 3, and 4). Thus, grooves 26 are formed between pairs of adjacent fins 24 so as to enable the fuel in the duct 6 to flow towards the main structure 4 in the form of a plurality of jets (or tubes) of fuel.

The fins 24 of the fuel atomizer plug 10 may be distributed regularly over the entire circumference of the cylindrical portion 22. They may also be twisted in a common direction, i.e. they may present angular twists in the same direction. Together they thus form threading.

The angular twist of the fins 24 is preferably about 45° relative to the axis XX'. This angular twist serves to create a swirl effect in the flow of fuel, and more particularly in the fuel jets, at the outlet from the fuel atomizer 10.

Furthermore, when the fuel injector 2, 2' includes an air swirler 14 disposed in the annular passage 8, the angular twist of the fins 24 is advantageously in the same direction as that of the swirler 14.

According to yet another advantageous characteristic of the invention, the injector system 2, 2' further comprises a device 28 for controlling the flow rate of the gas injected into the fuel duct 6. Such a device 28 thus serves to control the rate at which gas needs to be injected for the purpose of causing effervescence in the fuel. For example, the gas flow rate may be controlled as a function of the flow rate and the pressure $P_C$ of the fuel.

Particular features of the fuel injector 2 shown in FIGS. 1 to 3 are described below.

In this embodiment, the orifices 18 of the gas duct 16 open out into the fuel duct 6 through the fuel atomizer plug 10. To this end, the gas duct 16 extends axially as far as the atomizer plug 10 to which it is secured. The atomizer plug 10 may present a hollow cavity into which the gas duct 16 opens out, with the cavity leading to the orifices 18. Alternatively, the gas duct 16 and the atomizer plug could be made as a single piece.

More particularly, the orifices 18 of the gas duct 16 open out between pairs of adjacent fins 24 on the fuel atomizer plug 10, i.e. they open out into the grooves 26 in which the fuel jets form. As a result, the mixing between the fuel of the gas takes place in the zone of confluence between the orifices 18 and the grooves 26, and the resulting effervescence in the fuel causes the jets of fuel to disintegrate into fine drops.

As shown in FIG. 3, the orifices 18 advantageously open out tangentially into the gas duct 16, thereby amplifying the fuel swirl phenomenon created by the angular twist of the fins 24 on the atomizer plug 10.

The particular features of the fuel injector 2' shown in FIG. 4 are described below.

In this embodiment, the orifices 18 of the gas duct 16 open out into the fuel duct 6 upstream from the fuel atomizer plug 10'. The gas duct 16 extends axially as far as the atomizer plug 10' and it is secured thereto (or it may form a single piece therewith).

The orifices 18 may be arranged in two transverse planes. Thus, mixing between the fuel of the gas takes place in the zone of confluence between the orifices 18 and the zone of the gas duct 16 into which the orifices open out. Mixing between the liquid and the gas takes place before the mixture is dispersed in the form of jets via the atomizer plug 10'.

Still in this embodiment, it should also be seen in FIG. 4 that the fuel atomizer plug 10' presents a right section that is substantially conical.

Figure 5:
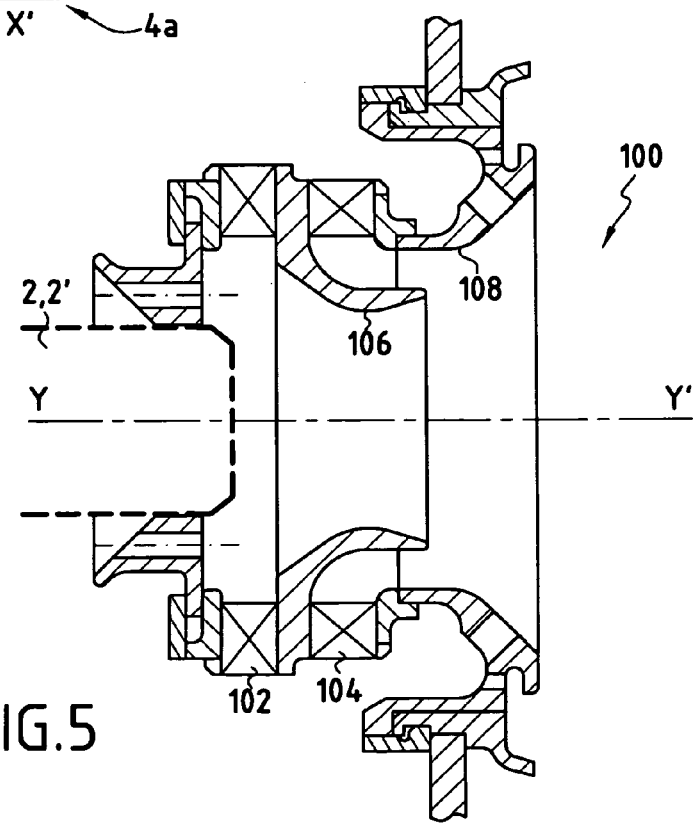
FIG. 5 is an axial section view of an air/fuel injection system fitted with an injector of the invention.
Figure 6:
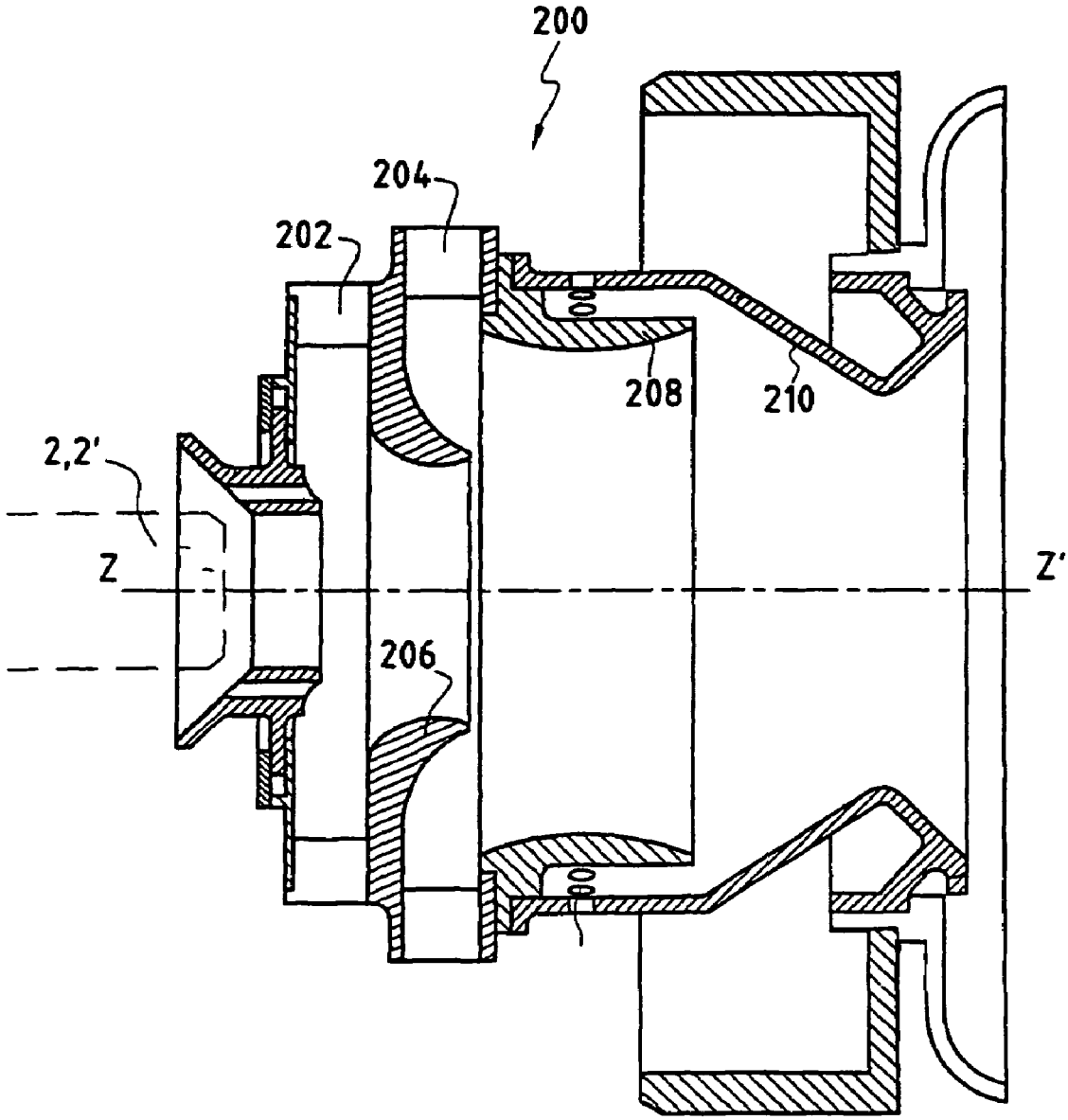
FIG. 6 is an axial section view of another air/fuel injection system fitted with an injector of the invention.

The fuel injector 2, 2' as described above is appropriate for aero-mechanical injection systems for injecting an air/fuel mixture into a turbomachine combustion chamber. FIGS. 5 and 6 thus show two variants of such aero-mechanical injection systems.

The injection system 100 shown in FIG. 5 comprises a fuel injector 2, 2' of the invention centered on its axis YY'. It further comprises an internal air swirler 102 disposed downstream from the injector 2, 2' and serving to inject air in a radial direction, and an external air swirler 104 disposed downstream from the internal air swirler 102 and serving likewise to inject air in a radial direction. The air swirlers 102 and 104 serve to set the flow of the air/fuel mixture into rotation, thereby increasing turbulence in order to enhance fuel atomization and mixing with air.

A Venturi 106 presenting an internal throat of convergent and divergent shape is interposed between the inner and outer air swirlers 102 and 104. It serves to mark the boundary between the flows of air coming from the air swirlers 102 and 104.

A bowl 108 that is flared downstream is mounted downstream from the outer air swirler 104. By means of its opening angle, the bowl 108 serves to distribute the air/fuel mixture over the primary zone of the combustion area.

The injection system 200 shown in FIG. 6 is likewise of the aero-mechanical type, so only the differences relative to the injection system 100 of FIG. 5 are described below. In particular, this injection system is of the lean pre-mixed pre-vaporized (LPP) type.

The injection system 200 includes a fuel injector 2, 2' of the invention centered on its axis ZZ'. It has an inner air swirler 202 disposed downstream from the injector 2, 2' serving to inject air in a radial direction, and an outer air swirler 204 disposed downstream from the inner air swirler 202 and serving to inject air in a radial direction.

A first Venturi 206 is interposed between the air injectors 202 and 204, and a second Venturi 208 is disposed downstream from the outer air swirler 204. A pre-mixer and/or pre-vaporization tube 210 is also disposed downstream from the second Venturi 208.

What is claimed is:

1. A fuel injector for an aero-mechanical injection system for injecting an air/fuel mixture into a turbomachine combustion chamber, the injector comprising:

a main tubular structure, with an axis of revolution XX', opening out at a downstream end for delivering the air/fuel mixture;

a tubular fuel duct disposed inside the main structure so as to co-operate therewith to form an annular passage, and opening out at a downstream end into the main structure via a fuel atomizer plug so as to introduce fuel at a pressure $P_C$ into the main structure; and at least one air feed channel connected to a compressor stage of the turbomachine and opening out into the annular passage in such a manner as to introduce air at a pressure $P_A$ into said passage;

the injector further including a tubular gas duct disposed inside the fuel duct and having a plurality of orifices opening out into said fuel duct to inject therein a gas at a pressure $P_G$ that is greater than $P_A$ and greater than or equal to $P_C$ so as to create effervescence in the fuel on being introduced into the main structure, the orifices of the gas duct being disposed in at least one common plane transverse to the axis of revolution XX', and the orifices of the gas duct opening out into the fuel duct through the fuel atomizer plug, wherein the tubular gas duct is the inner most duct.

2. The injector according to claim 1, wherein the orifices of the gas duct open out substantially perpendicularly into the fuel duct.

3. The injector according to claim 1, wherein the fuel atomizer plug comprises a cylindrical portion centered on the axis XX', having an outside diameter that is smaller than the inside diameter of the fuel duct, and provided with a plurality of profiled fins extending radially outwards, said fins having outside surfaces coming into contact with an inside surface of the fuel duct.

4. The injector according to claim 3, wherein the profiled fins of the fuel atomizer plug are distributed regularly over the entire circumference of the cylindrical portion.

5. The injector according to claim 3, wherein the profiled fins of the fuel atomizer plug present angular twist in a common direction.

6. The injector according to claim 5, wherein the angular twist of the profiled fins is at about 45° relative to the axis XX'.

7. The injector according to claim 3, wherein the orifices of the gas duct open out into the fuel duct through the fuel atomizer plug between pairs of adjacent fins thereof.

8. The injector according to claim 7, wherein the orifices of the gas duct open out tangentially into the gas duct.

9. The injector according to claim 1, further comprising a device for controlling the flow rate of the gas injected into the fuel duct.

10. An aero-mechanical injection system for injecting an air/fuel mixture into a turbomachine combustion chamber, the system comprising a fuel injector according to claim 1, and means for injecting air downstream from the fuel injector.

11. A system according to claim 10, including an inner air swirler disposed downstream from the injector configured to enable air to be injected in a radial direction, an outer air swirler disposed downstream from the inner air swirler, and configured to inject air in a radial direction, a Venturi interposed between the inner and outer air swirlers, and a bowl mounted downstream from the outer air swirler.

12. A system according to claim 10, comprising an inner air swirler disposed downstream from the injector and configured to enable air to be injected in a radial direction, an outer air swirler disposed downstream from the inner air swirler and configured to enable air to be injected into a radial direction, a first Venturi interposed between the inner and outer air swirlers, a second Venturi disposed downstream from the outer air swirler, and at least one of a pre-mixer or a pre-vaporization tube disposed downstream from the second Venturi.

13. A turbomachine combustion chamber including a fuel injector according to claim 1.

14. A turbomachine including a combustion chamber fitted with a fuel injector according to claim 1.

15. The injector according to claim 1, wherein the gas duct and the fuel atomizer plug are a single piece.

16. The injector according to claim 1, wherein an air swirler is disposed in the annular passage between an upstream end of the main structure and the downstream end of the main structure.

17. The injector according to claim 16, wherein the air swirler is configured to impart a rotary effect to the air introduced into the annular passage.

18. The injector according to claim 5, wherein an air swirler is disposed in the annular passage between an upstream end of the main structure and the downstream end of the main structure, said air swirler is configured to impart a rotary effect in the common direction of angular twist of the profiled fins of the fuel atomizer plug to the air introduced into the annular passage.

* * * * *